US012690701B2

(12) United States Patent
Zhu

(10) Patent No.: US 12,690,701 B2
(45) Date of Patent: Jul. 28, 2026

(54) SPHERICAL ARTIFICIAL PLANT STAND

(71) Applicant: Xiaoyun Zhu, Shenzhen (CN)

(72) Inventor: Xiaoyun Zhu, Shenzhen (CN)

( * ) Notice: Subject to any disclaimer, the term of this patent is extended or adjusted under 35 U.S.C. 154(b) by 31 days.

(21) Appl. No.: 19/001,205

(22) Filed: Dec. 24, 2024

(65) Prior Publication Data

US 2026/0165510 A1 Jun. 18, 2026

(30) Foreign Application Priority Data

Dec. 17, 2024 (CN) ..... 202423106512.4

(51) Int. Cl.
*F16M 11/00* (2006.01)
*A47G 7/04* (2006.01)

(52) U.S. Cl.
CPC ..... *A47G 7/041* (2013.01)

(58) Field of Classification Search
CPC ..... A47G 7/041
See application file for complete search history.

(56) References Cited

U.S. PATENT DOCUMENTS 4,611,441 A * 9/1986 Wickens ..... E04B 1/3211 52/81.4
5,452,555 A * 9/1995 Lee ..... E04C 2/384 52/584.1
6,070,991 A * 6/2000 Rumpel ..... F21V 19/0005 362/249.16
D1,029,351 S * 5/2024 Li ..... D26/118
D1,059,645 S * 1/2025 Chen ..... D26/25

* cited by examiner

*Primary Examiner* — Amy J. Sterling
(74) *Attorney, Agent, or Firm* — Daniel M. Cohn; Howard M. Cohn

(57) ABSTRACT

The utility model relates to the technical field of artificial plants, and discloses a spherical artificial plant stand, which comprises an upper hemispherical stand and a lower hemispherical stand; the upper hemispherical stand and the lower hemispherical stand form a hollow spherical shape; the upper hemispherical stand and the lower hemispherical stand are respectively formed by connecting two or more splicing piece bodies; the splicing piece body comprises a frame, transverse ribs and longitudinal ribs; the frame comprises a first bottom edge, a first side edge and a second side edge successively connected from end to end; the first bottom edge is provided with more than one first connecting part for splicing, and the second side edge is provided with more than one second connecting part for splicing. The spherical plant stand with an assembled structure has higher structural strength.

3 Claims, 4 Drawing Sheets

SPHERICAL ARTIFICIAL PLANT STAND

TECHNICAL FIELD

The utility model relates to the technical field of artificial plants, in particular to a spherical artificial plant stand.

BACKGROUND ART

Artificial plant decorations are required for interiors, exteriors, parks, roads or halls. However, the existing spherical artificial plant stand is mainly formed by splicing two hemispherical structures, which have large volume and occupy space during transportation, and are easily collapsed and deformed under the action of external forces and hardly recovered; die sinking is complicated in the injection molding process of the hemispherical structures, and the production cost is high. Therefore, improvements are required.

SUMMARY OF THE UTILITY MODEL

The utility model aims at the defects in the prior art to solve the technical problem, and provides a spherical artificial plant stand to solve the problems raised in the background art.

In order to solve the above technical problems, the utility model adopts the following technical proposal: a spherical artificial plant stand comprises an upper hemispherical stand and a lower hemispherical stand connected with the upper hemispherical stand; the upper hemispherical stand and the lower hemispherical stand form a hollow spherical shape; the upper hemispherical stand and the lower hemispherical stand are respectively formed by connecting two or more splicing piece bodies; the splicing piece body comprises a frame, transverse ribs arranged in the frame and longitudinal ribs arranged in the frame; the frame comprises a first bottom edge, a first side edge and a second side edge successively connected from end to end; the first bottom edge is provided with more than one first connecting part for splicing, and the second side edge is provided with more than one second connecting part for splicing.

Further, the first connecting part of the upper hemispherical stand is connected with the first connecting part of the lower hemispherical stand through a first fastener when the upper hemispherical stand and the lower hemispherical stand are connected.

Further, the first fastener is a cable tie or a screw or a nail-shaped protrusion.

Further, the second connecting part of the second side edge is connected with the first side edge of the adjacent splicing piece body through a second fastener when the upper hemispherical stand is spliced.

Further, the second connecting part of the second side edge is connected with the first side edge of the adjacent splicing piece body through a second fastener when the lower hemispherical stand is spliced.

Further, the second fastener is a cable tie or a screw or a nail-shaped protrusion.

Further, the transverse rib is uniformly provided with holes for connecting artificial plants.

Further, the first connecting part extends radially from the first bottom edge, and a first connecting hole for the first fastener to pass through is arranged on the first connecting part.

Further, the second connecting part extends radially from the second bottom edge, and a second connecting hole for the first fastener to pass through is arranged on the second connecting part.

Compared with the prior art, the utility model has the following beneficial effects:

1. The whole spherical plant stand adopts the splicing piece bodies, which are small in size, being more convenient to transport; the first connecting part and the second connecting part are arranged on the splicing piece body, and the first fastener and the second fastener are used between the adjacent splicing piece bodies; the splicing piece bodies are directly and more closely connected, the structural strength is better, the deformation resistance is good under the action of external force, and it is not easy to deform.
2. The splicing piece bodies are small in structure and more convenient in the injection molding production process, and has low production cost; meanwhile, the first connecting hole and the second connecting hole are designed on the splicing piece bodies to connect the artificial plants, thus being more convenient to operate and greatly reducing the difficulty of mold opening of the splicing piece bodies.

Figure 1:
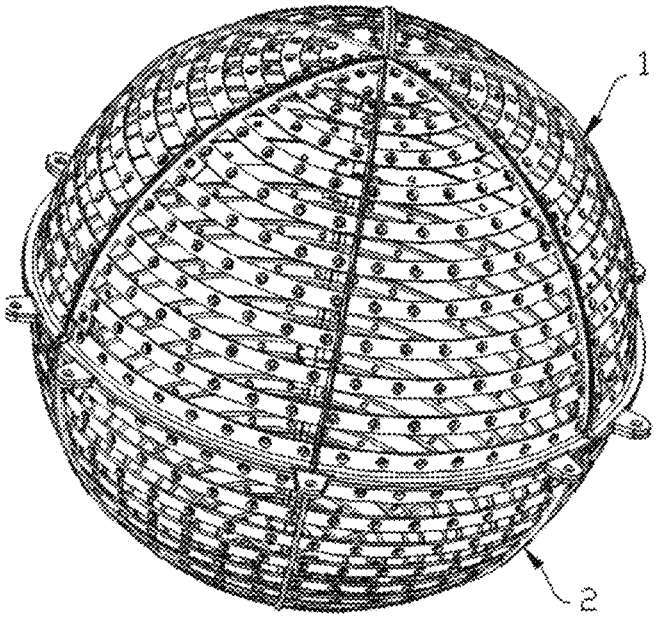
FIG. 1 is the structural diagram of the utility model.
Figure 2:
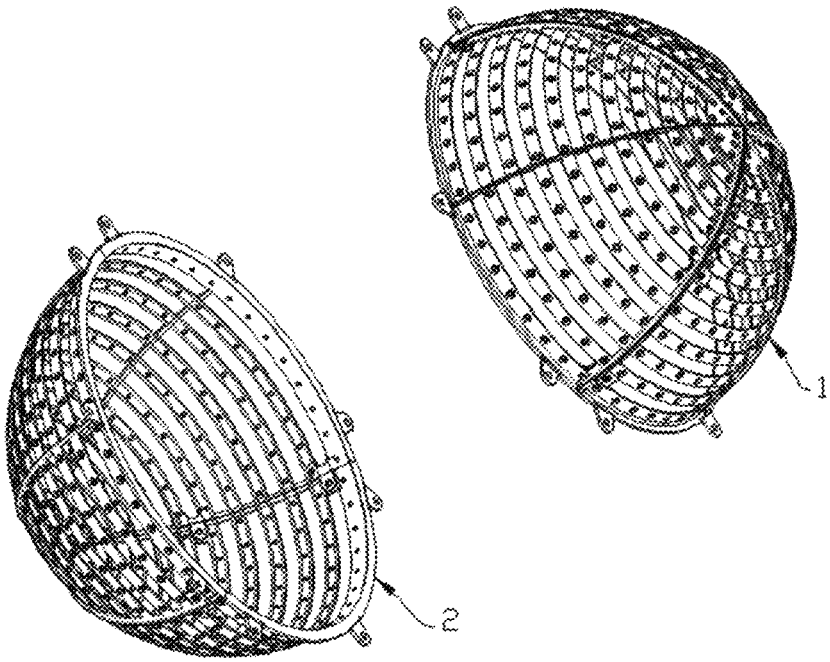
FIG. 2 is the schematic diagram for an explosive structure of the utility model.
Figure 3:
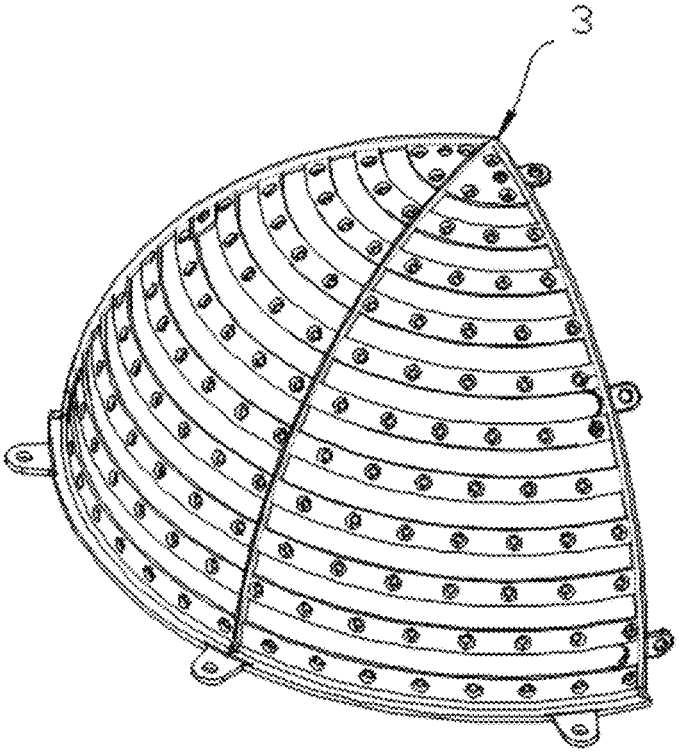
FIG. 3 is the structural diagram for a splicing piece body.
Figure 4:
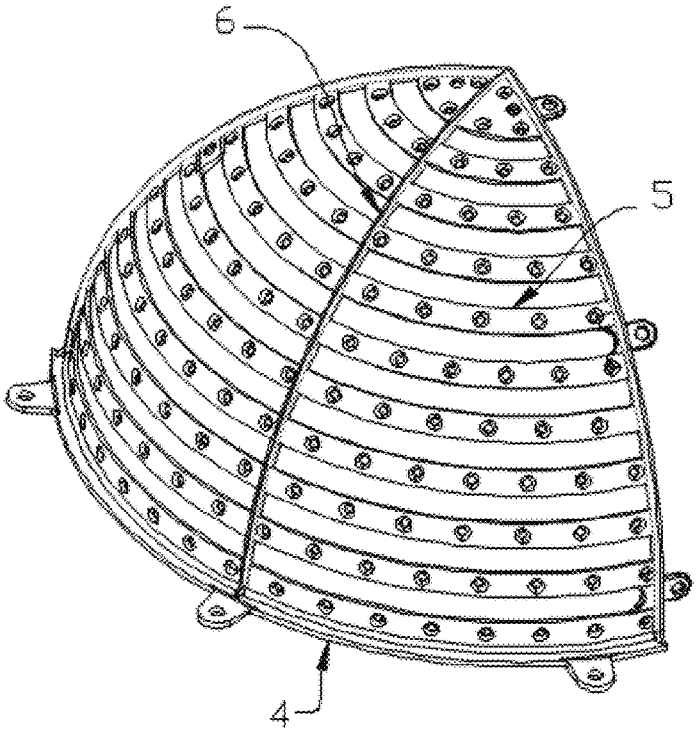
FIG. 4 is the structural diagram for a splicing piece body.

Reference signs: 1. Upper hemispherical stand; 2. Lower hemispherical stand; 3. Splicing piece body; Frame; 5. Transverse rib; 6. Longitudinal rib; 7. First bottom edge; 8. First side edge; 9. Second side edge; 10. First connecting part; 11. Second connecting part; 12. Hole; 13. First connecting hole; 14. Second connecting hole.

DETAILED DESCRIPTION OF THE UTILITY MODEL

The utility model is further explained in detail in combination with the drawings.

The embodiments described by reference to the drawings are exemplary, are intended to explain the application and are not construed as limitations to the application. In the description of the application, it is necessary to understand that the orientation or position relations indicated by the terms such as "center", "longitudinal", "transverse", "length", "width", "thickness", "upper", "lower", "front", "rear", "left", "right", "vertical", "horizontal", "top", "bottom", "inner", "outer", "clockwise" and "anticlockwise" are based on the orientation or position relations shown in the drawings, and are only intended to facilitate the description and simplify the description of the application, but not intended to indicate or imply that the device or element referred to must have a particular orientation or be constructed and operated in a particular orientation, therefore they are not construed as limitations to the application. In addition, the terms "first" and "second" are used for descriptive purposes only and are not understood as indicating or implying relative importance or implicitly indicating the quantity of technical features indicated. Thus, a feature defined as "first" or "second" may explicitly or implicitly include one or more such features. In the description of the application, "a plurality of" or "more" means two or more unless otherwise expressly specified. In the application, unless otherwise expressly specified and limited, the terms such as "installed", "connected with", "connected" and "fixed" shall be understood in a broad sense, for example, "connected" may be fixedly connected or detachably connected or integrally connected; it may be mechanically connected or electrically connected; it may be directly connected or indirectly connected through an intermediate medium, or connected between two components. Ordinary technicians in the field may understand the specific meanings of the above terms in the application on a case-by-case basis. In the application, unless otherwise expressly specified and limited, the first feature "above" or "under" the second feature may include direct contact between the first and second features, or may include indirect contact between the first and second features but contact through another feature between them. Furthermore, the first feature "above", "over" and "on" the second feature includes the first feature being directly above and over the second feature, or simply indicates that the first feature is at a higher level than the second feature. The first feature "below", "under" and "underneath" the second feature includes the first feature being directly above and over the second feature, or simply indicates that the first feature is at a lower level than the second feature.

In view of the technical problems set forth in the background art, as shown in FIG. 1 to FIG. 7, the utility model provides a spherical artificial plant stand, which comprises an upper hemispherical stand 1 and a lower hemispherical stand 2 connected with the upper hemispherical stand 1; the upper hemispherical stand 1 and the lower hemispherical stand 2 form a hollow spherical shape; the upper hemispherical stand 1 and the lower hemispherical stand 2 are respectively formed by connecting two or more splicing piece bodies 3; the splicing piece body 3 comprises a frame 4, transverse ribs 5 arranged in the frame 4 and longitudinal ribs 6 arranged in the frame 4; the frame 4 comprises a first bottom edge 7, a first side edge 8 and a second side edge 9 successively connected from end to end; the first bottom edge 7 is provided with more than one first connecting part 10 for splicing, and the second side edge 9 is provided with more than one second connecting part 11 for splicing.

In the implementation, as a preferred embodiment, the splicing piece body 3 can be prepared as a quarter of sphere, one sixth of sphere or one eighth of sphere, etc., which can be selected according to the actual needs. Below, one sixth of sphere is preferred as the splicing piece body 3.

Because of the small structure and small volume, the splicing piece bodies 3 can be stacked; meanwhile, the splicing piece body 3 is generally prepared by injection molding, and the splicing piece body 3 becomes smaller, which is more convenient for the mold design of the splicing piece body 3, thus reducing the production difficulty and the production cost.

During assembly, the splicing piece body 3 is connected with another splicing piece body 3 through the second connecting part 11 to form the upper hemispherical stand 1 and the lower hemispherical stand 2, and then the upper hemispherical stand 1 and the lower hemispherical stand 2 are connected through the first connecting part 10 to form a spherical artificial plant stand, and then artificial plants can be connected to the transverse ribs 5 or the longitudinal ribs 6 to complete the assembly operation. The transverse ribs 5 can be distributed at intervals on the splicing piece body 3, and the number thereof can be set according to the use requirements; the longitudinal ribs 6 can be distributed at intervals on the splicing piece body 3, and the number thereof can be set according to the use requirements; the transverse ribs 5 and the longitudinal ribs 6 can be used as the basis for installing the artificial plants and can improve the overall structural strength, being not easy to deform.

Specifically, the first connecting part 10 of the upper hemispherical stand 1 is connected with the first connecting part 10 of the lower hemispherical stand 2 through a first fastener when the upper hemispherical stand 1 and the lower hemispherical stand 2 are connected. The first fastener is a cable tie or a screw or a nail-shaped protrusion.

The number of first connecting parts 10 can be set according to the implementation requirements, the first connecting parts 10 are evenly distributed on the first bottom edge 7, the first fastener is a cable tie or screw or nail-shaped protrusion during connection, and the first connecting parts of the upper hemispherical stand 1 and the lower hemispherical stand 2 are tightened through the cable tie; the first connecting parts of the upper hemispherical stand 1 and the lower hemispherical stand 2 are connected through screws; either of the first connecting parts of the upper hemispherical stand 1 and the lower hemispherical stand 2 is provided with the nail-shaped protrusion, which can be integrated with the first connecting part by the fastening method of the nail-shaped protrusion, thus improving the structural strength and preventing deformation.

Specifically, the second connecting part 11 of the second side edge 9 is connected with the first side edge 8 of the adjacent splicing piece body 3 through a second fastener when the upper hemispherical stand 1 is spliced. The second connecting part 11 of the second side edge 9 is connected with the first side edge 8 of the adjacent splicing piece body 3 through a second fastener when the lower hemispherical stand 2 is spliced. The second fastener is a cable tie or a screw or a nail-shaped protrusion.

The number of second connecting parts 11 can be set according to the implementation requirements, the second connecting parts 11 are evenly distributed on the second bottom edge 9, the second fastener is a cable tie or screw or nail-shaped protrusion during connection, and the second connecting parts of the upper hemispherical stand 1 and the lower hemispherical stand 2 are tightened through the cable tie; the second connecting parts of the upper hemispherical stand 1 and the lower hemispherical stand 2 are connected through screws; either of the second connecting parts of the upper hemispherical stand 1 and the lower hemispherical stand 2 is provided with the nail-shaped protrusion, which can be integrated with the second connecting part by the fastening method of the nail-shaped protrusion, thus improving the structural strength and preventing deformation.

Figure 5:
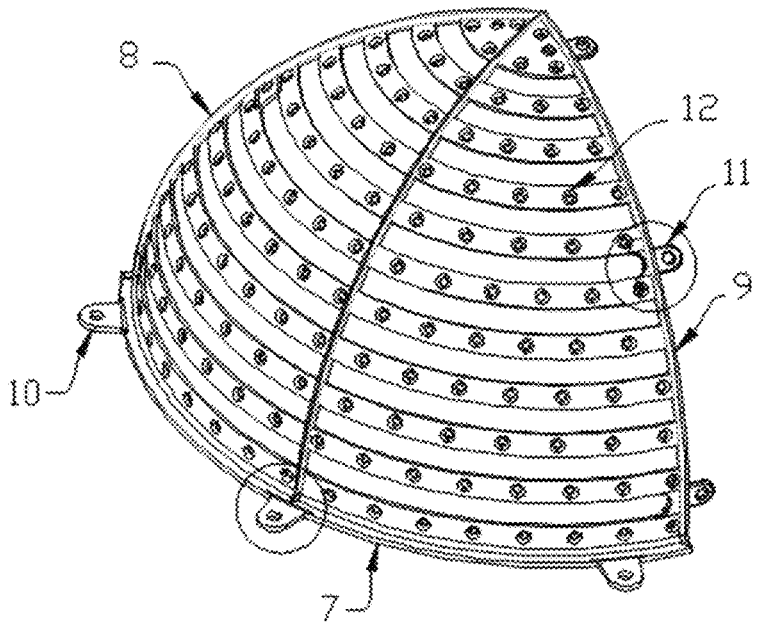
FIG. 5 is the structural diagram for a splicing piece body.

As shown in FIG. 5, the transverse rib 5 is uniformly provided with holes 12 for connecting artificial plants.

At present, a barb structure protruding upward on the transverse rib 5 is used in the market, and is connected with the artificial plants. However, the barb structure leads to the high cost of mold opening of the hemispherical stand, and the connection strength of each barb structure cannot be guaranteed. For this reason, the utility model designs a hole 12 on the transverse rib 5, so that the mold opening design of the splicing piece body 3 is convenient, the production cost is reduced, and the artificial plant is connected to the hole 12, thus more easily ensuring the connection strength and being firmer.

Figure 6:
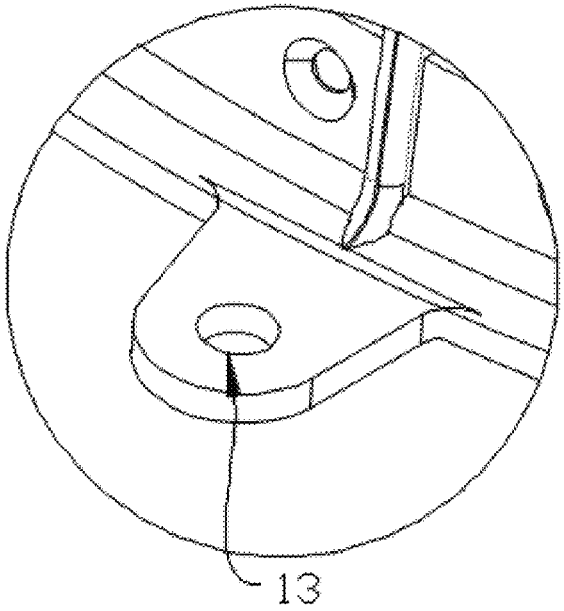
FIG. 6 is the partial enlarged structure view of FIG. 5.
Figure 7:
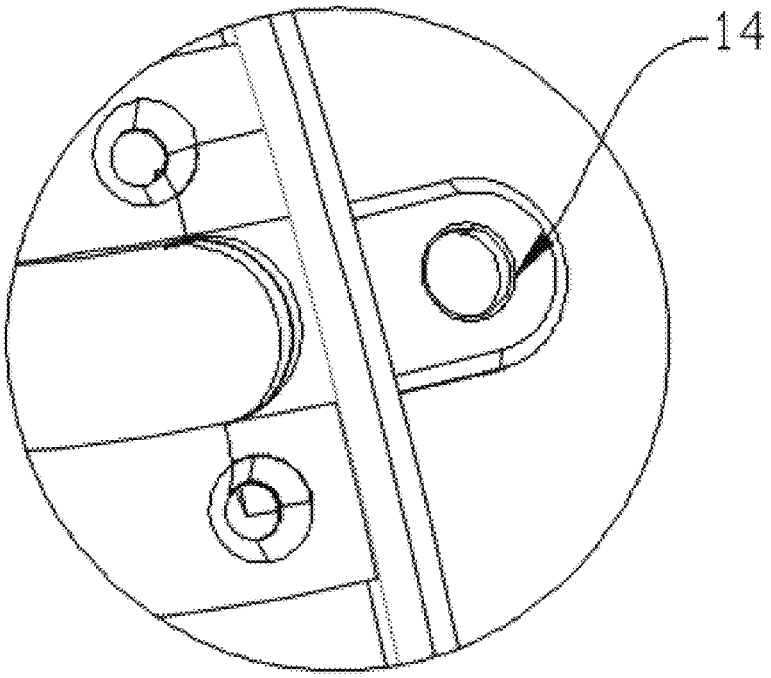
FIG. 7 is the partial enlarged structure view of FIG. 5.

As shown in FIG. 6 and FIG. 7, the first connecting part 10 extends radially from the first bottom edge 7, and a first connecting hole 13 for the first fastener to pass through is arranged on the first connecting part 10.

The second connecting part 11 extends radially from the second bottom edge 9, and a second connecting hole 14 for the first fastener to pass through is arranged on the second connecting part 11.

Preferably, the first connecting part 10 extends radially along the first bottom edge 7, and the cable tie is tightly connected through the first connecting holes 13 of the upper hemispherical stand 1 and the lower hemispherical stand 2 when the upper hemispherical stand 1 and the lower hemispherical stand 2 are connected; or the screw is connected through the first connecting hole 13 of the upper hemispherical stand 1 and the lower hemispherical stand 2; or any first connecting part 10 is provided with the nail-like protrusion and connected to the first connecting hole 13 through the nail-like protrusion; the second connecting part 11 extends outward from the second side edge 9, the second connecting part 11 extends at least to the first side edge 8 of the other splicing piece body when the adjacent splicing piece body 3 is connected, and the second connecting hole 14 of the second side edge 9 of the splicing piece body can be tightened with the first side edge 8 of the other splicing piece body when the cable tie is used for connection; or the screw is connected through the second connecting hole 14; or any second connecting part 11 is provided with the nail-like protrusion and connected to the second connecting hole 14 through the nail-like protrusion to improve the structural strength.

The above embodiments do not limit the technical scope of the utility model, and any modification, equivalent changes and modifications made to the above embodiments in accordance with the technical substance of the utility model still fall within the scope of the technical proposal of the utility model.

The invention claimed is:

1. A spherical artificial plant stand, comprising an upper hemispherical stand and a lower hemispherical stand connected to the upper hemispherical stand, wherein:

the upper hemispherical stand and the lower hemispherical stand form a hollow spherical shape;

the upper hemispherical stand and the lower hemispherical stand are respectively formed by connecting a plurality of splicing piece bodies;

each of the splicing piece bodies comprise a frame, a plurality of transverse ribs arranged in the frame, and a plurality of longitudinal ribs arranged in the frame;

the frame comprises a first bottom edge, a first side edge, and a second side edge successively connected from end to end;

the first bottom edge is provided with a plurality of first connecting parts for splicing;

the second side edge is provided with a plurality of second connecting parts for splicing; and each of the transverse ribs are uniformly provided with a plurality of holes for connecting to a plurality of artificial plants.

2. The spherical artificial plant stand of claim 1, wherein each of the first connecting parts extend radially from the first bottom edge, further comprising a first connecting hole arranged on each of the first connecting parts.

3. The spherical artificial plant stand of claim 1, wherein each of the second connecting parts extend radially from the second bottom edge, further comprising a second connecting hole arranged on each of the second connecting parts.

* * * * *